US005632188A

United States Patent [19]

Karlis

[11] Patent Number: 5,632,188

[45] Date of Patent: May 27, 1997

[54] ERGOPUNCH

[75] Inventor: Robert G. Karlis, Hingham, Mass.

[73] Assignee: Clix Products, Inc., Natick, Mass.

[21] Appl. No.: 394,153

[22] Filed: Feb. 24, 1995

[51] Int. Cl.[6] ..... B26F 1/02

[52] U.S. Cl. ..... 83/167; 83/618; 83/633; 83/687; 83/698.91

[58] Field of Search ..... 83/687, 627, 628, 83/167, 599, 698.91, 618, 633

[56] References Cited

U.S. PATENT DOCUMENTS

| | | | |
|---|---|---|---|
| 2,244,660 | 6/1941 | Carpenter | 83/167 |
| 2,474,344 | 6/1949 | Carpenter | 83/167 |
| 3,392,913 | 7/1968 | Neilsen | 83/549 |
| 3,404,593 | 10/1968 | Arcarese et al. | 83/167 |
| 4,036,088 | 7/1977 | Ruskin | 83/167 |
| 4,449,436 | 5/1984 | Semerjian et al. | 83/549 |
| 4,656,907 | 4/1987 | Hymmen | 83/167 |
| 4,713,995 | 12/1987 | Davi | 83/167 |
| 4,829,867 | 5/1989 | Neilsen | 83/689 |
| 5,247,863 | 9/1993 | Cohen | 83/167 |

FOREIGN PATENT DOCUMENTS

| | | | |
|---|---|---|---|
| 1231669 | 1/1967 | Germany | 83/167 |

*Primary Examiner*—Eugenia Jones
*Assistant Examiner*—Charles Goodman
*Attorney, Agent, or Firm*—Morse, Altman & Benson

[57] ABSTRACT

The present invention is an ergonomic paper punch, which includes a die body, a press body, and a plurality of punch heads. The die body and the press body are pivotally connected along an axis for a rocking motion, with the die body and press body forming a "V" shape when viewed in a cross-section perpendicular to the axis. The die body has a die base with a plurality of die holes, an equal number of brackets with guide holes, and a paper reception region in between the base and brackets. A portion of the upper surface of the press body is covered by a resilient, textured surface. The underside of the die base has a region for holding the punch-outs that is covered by a resilient tray. The tray is secured to the top surface of the die base, extends around the die base, and covers the punch-out holding region. The tray is completely detachable from the punch-out holding region so the region can be emptied, but remains attached to the die base so as to not get lost. The tray contains a closable aperture that can also be used to empty the punch-out holding region. The center section of the lower rear edge of the tray is curved, rather than squared off.

11 Claims, 5 Drawing Sheets

ERGOPUNCH

BACKGROUND OF THE INVENTION

1. Field of the Invention

The present invention relates to paper punches, i.e. punches for perforating sheets of paper for insertion into loose-leaf ring binders, and, more particularly, to user friendly, i.e. ergonomic, paper punches.

2. The Prior Art

Punches for perforating sheets of paper for insertion into loose-leaf ring binders and for retention therein have been known for many years. Typically, a paper punch includes a metal base and a metal upper plate pivotally attached thereto. Mounted between the base and the upper plate are several punch heads, wherein, when the upper plate is pressed toward the base, it rotates about the pivot attachment, forcing the punch heads to extend into mating holes in the base. When pressure is released from the upper plate, a spring forces the upper plate back to its inoperative position, retracting the punch heads from their mating holes.

Typically, the base is hollow for holding the paper punch-outs. The bottom wall of the base is a tray and is removable to allow for disposal of the punch-outs. The tray may be a pliable plastic so it can be removed from the metal base. As such, it is not an integral part of the base and may tend to become lost.

There are two general method of using a paper punch: on a flat surface, such as table desk top, or held in one's hand. When used on a flat the base is set on the flat surface, the paper is between the punch heads and mating holes, and the operator presses down the upper plate. If the operator's hand is too far back on the upper plate, the paper punch may rock backwards when the plate is pressed. As a result, the front of the base may lift from the table top, thereby causing paper to slip out and the punched holes to be misaligned. Also, because the typical upper plate is rigid and smooth the operator's hand may tend to slip when applying pressure, thereby also causing the paper slippage and punched hole misalignment.

When being used as a hand-held device, the paper punch is cradled in the operator's hand so that, when the hand is clenched, the base and upper plate are squeezed together. With a rigid and smooth upper plate or base, it may be difficult, especially for an operator with a small hand, to grip the paper punch securely and comfortably. In particular, because the edges of the plate and base typically are sharp, the edges jab into the operator's hand. In addition, an operator with a small hand may not have the leverage necessary for punching in the maximum number of sheets that the paper punch can accommodate.

SUMMARY OF THE INVENTION

The object of the present invention is to provide an ergonomic paper punch that is easy and comfortable to use when hand-held and that is stable and secure when used on a table top. The ergonomic paper punch of the present invention overcomes various disadvantages inherent in the prior art by virtue of its configuration and surfacing. The preferred embodiment of the ergonomic paper punch includes a die body, a press body, and a plurality of punch heads of a particular design.

The die body and the press body are pivotally connected along an axis for a rocking motion, with the die body and press body forming a "V" shape when viewed in a cross-section perpendicular to the punch's longitudinal axis. The vertex of the "V" preferably has an angle of about 30°.

The die body has a rigid die base with a plurality of die holes, an equal number of brackets with guide holes, and a paper reception region in between the base and brackets. The bottom of the die base has a width that is at least 20% of its length. This minimum ratio of width to length gives the ergonomic paper punch of the present invention more stability than the typical prior art paper punch when used on a table top. Each punch head is mounted within the guide holes of one bracket.

Preferably, the press body is rigid. The top of the press body preferably has three substantially straight sides that are adjacent to the paper reception region and a fourth side that is a smooth convex curve. The length of the press body is substantially the same as the length of the base, and the widest part of the top view is in the center of the curve and has a width that is at least 22% of the length of the press body. A portion of the upper surface of the press body covered by a resilient, textured overlay.

The underside of the die body base preferably has a region for holding the punch-outs, the pieces of paper that result from punching holes. Preferably, this region is covered by a resilient tray so that the punch-outs are held within the region. The tray is secured to the top surface of the die body base, extends around the base, and covers the punch-out holding region. The tray is completely detachable from the punch-out holding region so the region can be emptied, but remains attached to the die base so as to not get lost. The tray also contains a closable aperture. The aperture is used to empty the punch-out holding region and the tray is not normally detached from the punch-out holding region.

The center section of the rear edge of the resilient tray is curved, rather than squared off, as in the typical prior art paper punch. The outer portions of the edge are squared off to extend the base rearwardly to maximize the width to length ratio, thus providing a more stable base when used on a table top. In addition, the material used for the tray is non-slip and provides a more secure footing on a table top.

When held in the hand for use, the combination of the 30° "V" angle, the rigid die base, the resilient tray with a rounded rear edge and non-slip surface, and a rigid press body with a resilient, textured overlay provides a more secure and comfortable grip than that of the typical prior art paper punch.

Other objects of the present invention will in part be obvious and will in part appear hereinafter.

BRIEF DESCRIPTION OF THE DRAWINGS

For a fuller understanding of the nature and object of the present invention, reference is made to the accompanying drawings, wherein.

DETAILED DESCRIPTION OF THE PREFERRED EMBODIMENT

Figure 1:
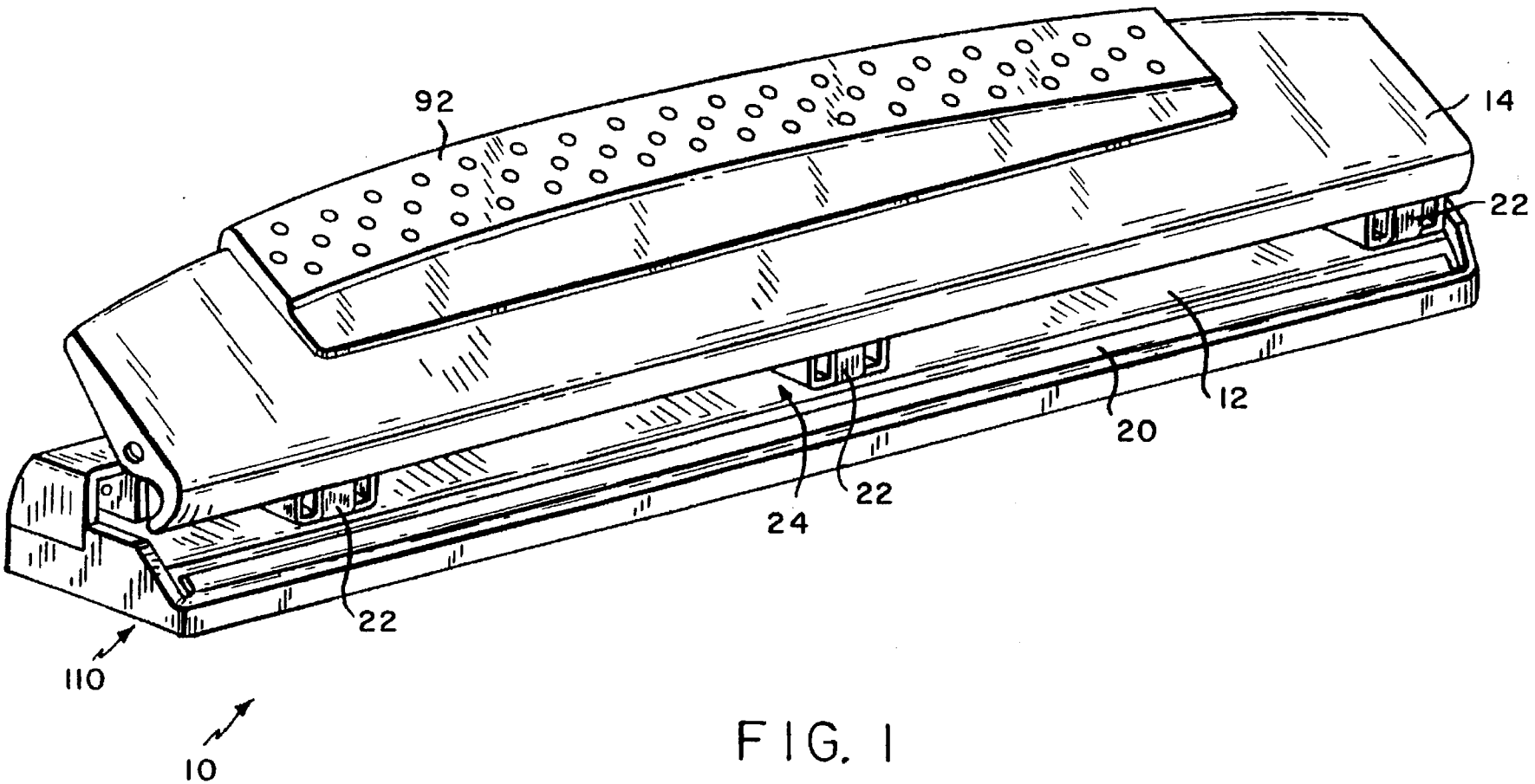
FIG. 1 is an isometric view of the front of the present invention.
Figure 2:
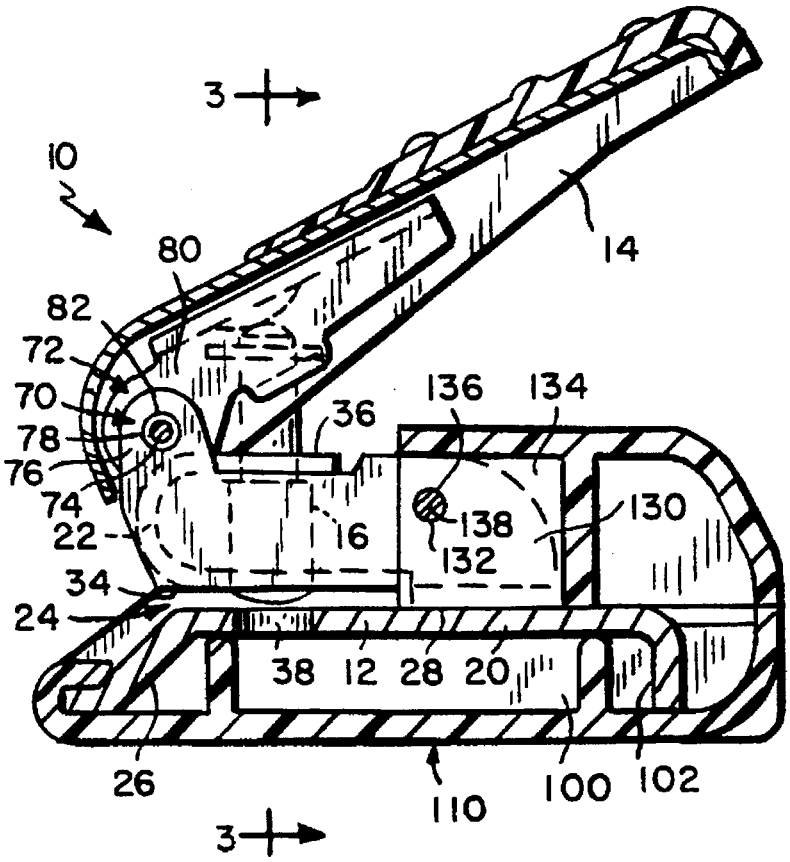
FIG. 2 is a profile of the paper punch in cross-section.
Figure 4:
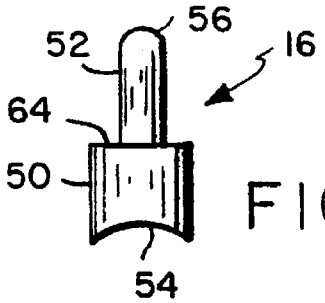
FIG. 4 is a front view of a punch head.
Figure 5:
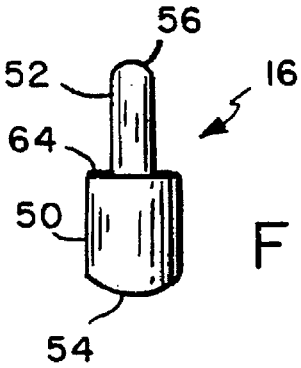
FIG. 5 is a side view of a punch head.

The illustrated embodiment of the paper punch 10 of the present invention is shown in FIGS. 1 and 2 as comprising a lower die body 12, an upper press body 14, and a plurality, in this case three, punch heads 16. The punch heads 16, which are shown in FIGS. 3–5, are partially hidden from view in the assembled product.

The die body includes a rigid, elongated die base 20, three brackets 22 that are attached to the die base as shown at 28, and a paper reception slot 24 formed between the die base 20 and brackets 22. In the preferred embodiment, the die base 20 is composed of 0.074 inch cold rolled steel and the width of the die base 20 is at least 20% of its length. The entire length of the front edge 26 of the die base 20 is angled away from the brackets 22 to facilitate entry of paper sheets into the paper reception slot 24.

Figure 3:
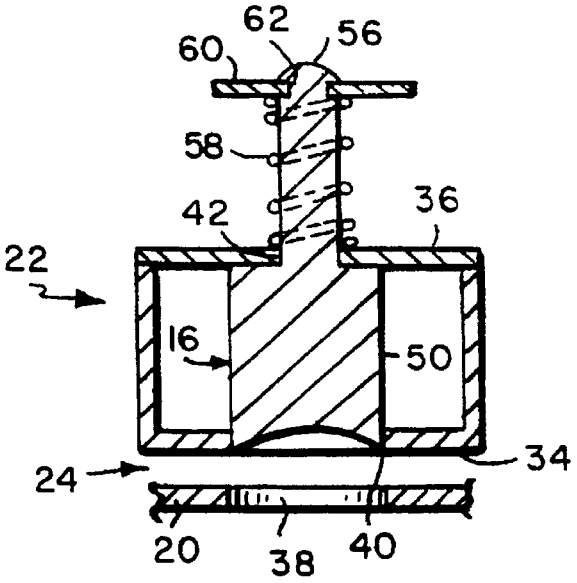
FIG. 3 is a cross-sectional view of a punch head assembly at line 3—3 of FIG. 2.

As seen in FIGS. 2 and 3, the brackets 22 have a lower wall 34, which, in conjunction with the die base 20, forms the paper reception slot 24. The lower wall 34 provides the critical function of stripping the paper sheet 30 from the punch heads 16 when the punch heads 16 retract into their open positions. The brackets have an upper wall 36 parallel to and spaced from the lower wall 34. Below each bracket 22 is a die hole 38 that extends through the die base 20, a lower guide hole 40 that extends through the lower wall 34, and an upper guide hole 42 that extends through the upper wall 36. The die hole 38 and the lower guide hole 40 have the same diameter and the upper guide hole 42 has a diameter smaller than that of the die hole 38 and lower guide hole 40. The die hole 38 and both guide holes 40, 42 are axially aligned. Each punch head 16 is constrained by the guide holes 40, 42 for reciprocation along the axis of the die hole 38 and the guide holes 40, 42.

The lower portion 50 of each the punch head 16, which includes about half the length of the punch head 16, has a diameter slightly smaller than the diameter of the die hole 38 and the lower guide hole 40, but greater than the diameter of the upper guide hole 42. The upper portion 52 of each punch head 16, which includes the length of the punch head not associated with the lower portion 50, has a diameter slightly smaller than the diameter of the upper guide hole 42.

The lower end of each punch head 16 has an undulant configuration that provides its rim with a sharp cutting edge 54. As shown in FIGS. 4 and 5, the cutting edge 54 is concave when viewed from the front, and convex when viewed from the side.

Each punch head 16 is positioned within one set of guide holes 40, 42, with the lower edge 54 adjacent to the paper reception slot 24. A coil spring 58 is positioned around the upper portion 52 of the punch head between the upper wall 34 of the bracket and the upper end 56 of the punch head 16. A circular retainer 60 is set within a circumferential groove 62 located near the upper end 56 to hold the coil spring 58 in place.

As shown in FIG. 2, the upper end 56 is positioned under the press body 14. Preferably the press body 14 is composed of 0.035 inch cold rolled steel. The press body 14 controls the movement of the punch heads 16 between an inactive position, in which the cutting edge 54 of the punch heads is recessed in the lower guide hole 40, and an active position, in which the cutting edge 54 is projecting through the paper reception slot 24 (and any paper sheets therein) into the die hole 38. Manual force of the operator on the press body 14 causes the punch heads 16 to move to their active position and, when the manual force is removed, the coil springs 58 return the punch heads 16 to their inactive position. The shoulder 64 on the circumference of the punch head 16 created by the difference in diameter between the lower portion 50 and upper portion 52 of the punch head 16 precludes the punch heads 16 from retracting completely through the lower guide holes 40.

The die body 12 and the press body 14 are pivotally connected along an axis 70 that allows for a rocking motion. When viewed in cross-section perpendicular to the axis 70, as in FIG. 2, the die body 12 and press body 14 form a tilted "V" shape. In the preferred embodiment, the vertex 72 of the "V" has an angle of about 30°. The axis 70 is formed by a straight rod 74 extending through holes 78 in ears 76 that project upwardly from the brackets 22 and through holes 82 in ears 80 extending downwardly from the press body 14.

Figure 6:
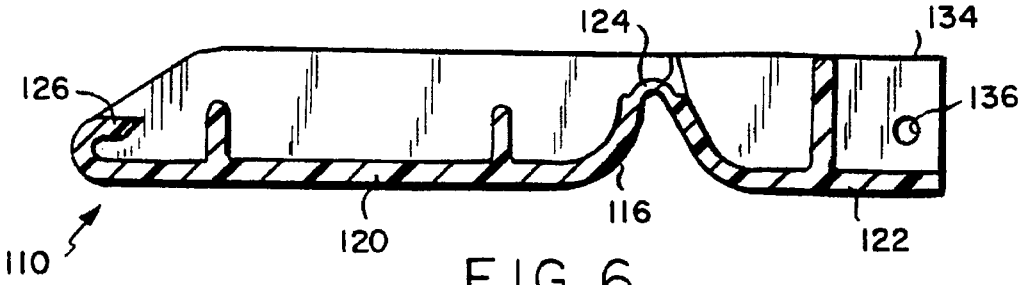
FIG. 6 is a profile of the tray in cross-section.

The underside of the die base 20 forms the upper wall of a region 100 for holding the punch-outs, the round pieces removed from the newly cut holes in the paper. The angled front edge 26 of the die base 20 forms the front wall. The rear wall 102 is formed by a downwardly extending lip on the rear edge of the die base 20. The remaining two walls and bottom of the punch-out holding region 100 are formed as parts of a tray 110 that is made from a resilient material. As shown in FIG. 6, the tray 110 also has a rear wall 116 that overlaps with the rear wall 102 of the die base 20.

Figure 7:
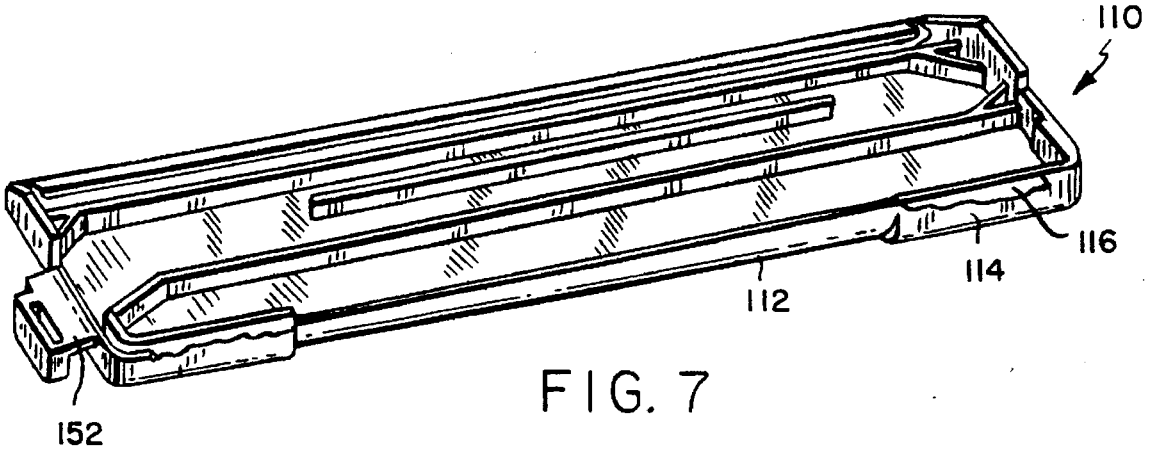
FIG. 7 is an isometric view of the rear of the lower portion of the tray.

The lower rear edge of the tray is shaped to make holding the punch in the hand more comfortable and secure. In the preferred embodiment, shown in FIG. 7, the center portion of the lower rear edge 112 of the tray 110 is substantially monotonically curved over at least 10% of the width of the tray 110, where a monotonic curve is a curve that is either always increasing or remaining the same or is always decreasing or remaining the same. The outer portions of the lower rear edge 114 are also curved, but are substantially rounded with a radius of less than 5% of the width of the tray 110.

Figure 8:
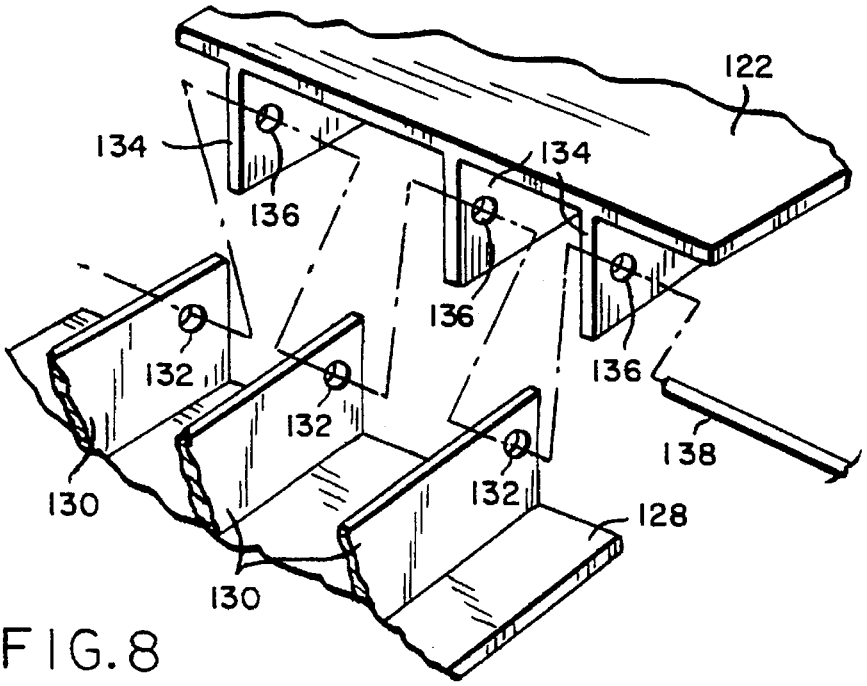
FIG. 8 is an exploded view of the attachment of the tray and die base.

The tray 110 has two portions, a lower portion 120 and an upper portion 122. The two portions 120, 122 are connected by an integral hinge 124 that extends less than the entire length of the tray 110. The lower portion 120 is formed with a lip 126 that hugs the edge of the front wall of the punch-out holding region 26. The integral hinge 124 is adjacent to the rear wall 102 of the punch-out holding region and the upper portion 122 is permanently attached to the top 128 of the die base. As shown in FIG. 8, the means for permanently attaching the upper portion 122 to the top 128 of the die base includes ears 130 extending substantially upwardly and perpendicularly from the top 128 of the die base, walls 134 extending substantially downwardly and vertically from the bottom of the upper portion 122, holes 136 through each of the ears 130 and upper portion walls 134 aligned along a common axis, and a linear rod 138 extending through the ear holes 132 and the wall holes 136.

The punch-out region 100 may be emptied in either of two ways. First, the lower portion 120 is detached from the punch-out holding region 100 by manually deforming the tray lip 126, separating it from the front wall of the die base 26 and pivoting it away rearwardly from the die base 20 along the integral hinge 124 between the lower portion 120 and upper portion 122. When the lower portion 120 is detached, the punch-out holding region 100 is completely opened for emptying, but the tray 110 remains attached to the die base 20.

Figure 9:
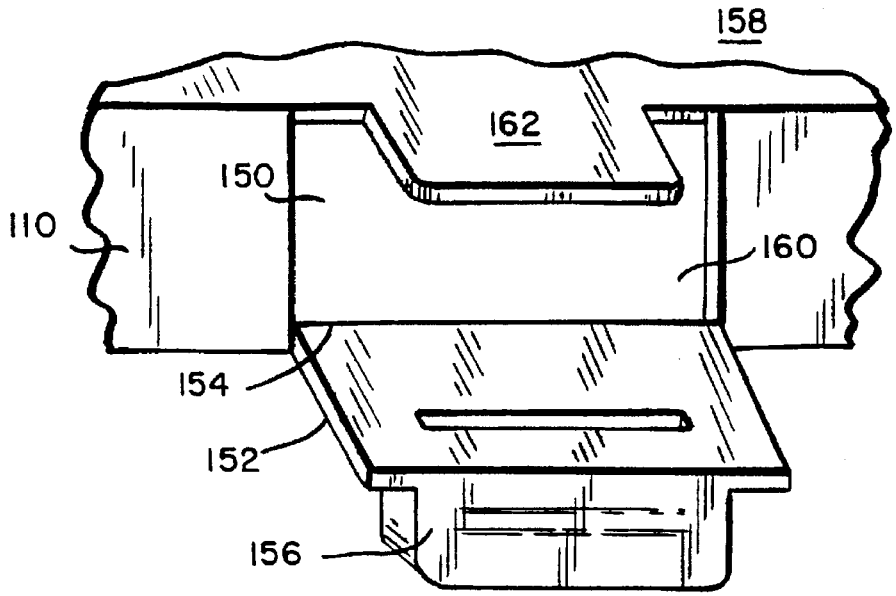
FIG. 9 is an isometric view of the aperture.

Secondly, the punch-out holding region 100 may be emptied by using a closable aperture 150 formed in one of the side walls of the lower portion 120. Preferably, as shown in FIG. 9, the aperture 150 is closed by a hinged panel 152 that is integrally formed with the tray 110. The hinge 154 connects the panel 152 to the lower wall 160 of the tray 110 such that the panel 152 rotates downwardly to open the aperture 150. The punch-out holding region 100 is emptied by opening the aperture 150 and tilting the paper punch 10 such that the punch-outs fall out of the open aperture 150. When not emptying the punch-out holding region 100, the aperture 150 is closed to securely hold the punch-outs within the punch-out holding region 100. To close, the upper edge of the panel 152 is secured to the die base 20 by a lip 156 formed in its upper edge to hug a tab 162 that protrudes from the edge of the upper wall 158 of the punch-out holding region 100.

Figure 10:
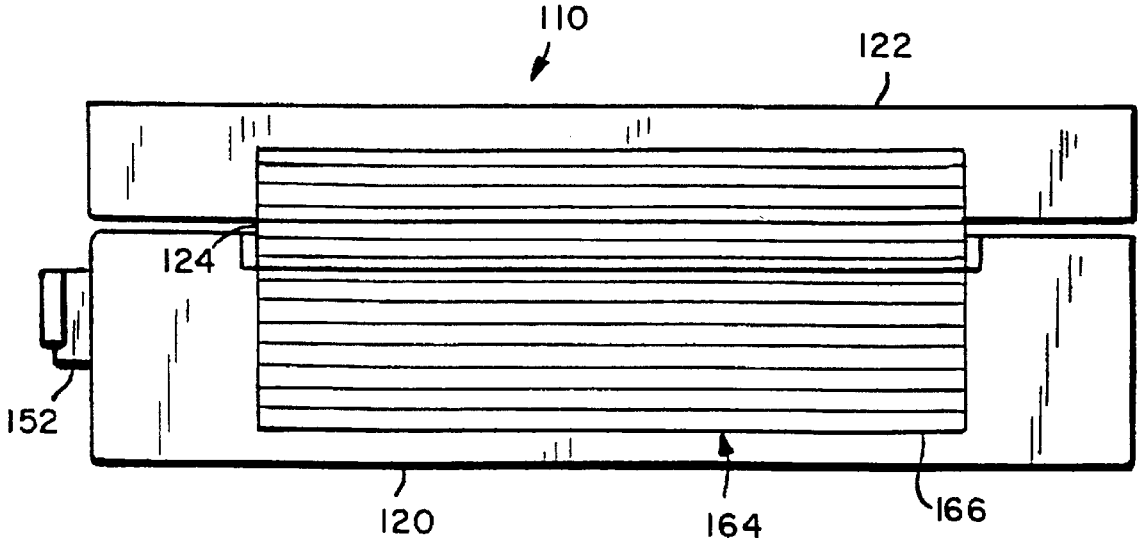
FIG. 10 is a bottom plan view of the tray.

A portion of the outer surface of the tray 110 has a non-slip surface 164 for maintaining secure contact with the surface on which it is placed for use and for helping the operator maintain a secure grip. In the preferred embodiment, shown in FIG. 10, non-slip surface 164 includes a plurality of substantially parallel grooves 166.

Figure 11:
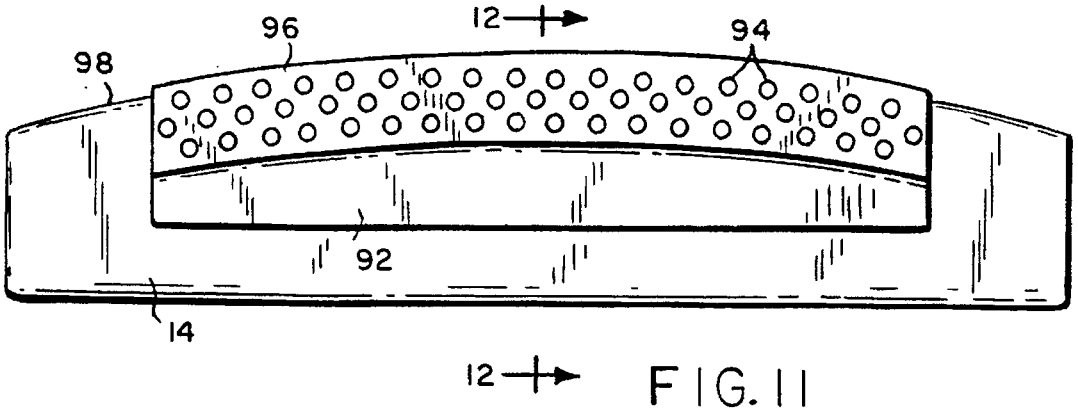
FIG. 11 is a top plan view of the press body.

FIG. 11 shows a top plan view of the press body 14. Preferably, the press body 14 is rigid. Three sides are substantially straight and at right angles. The fourth side 90 is defined by a substantially smooth, convex curve, which, in the preferred embodiment, has a radius of about 20 inches. The measurement at the widest point of the top of the press body 14 is at least 22% of the length of the press body 14.

Attached to a portion of the top surface of the press body 14 is a textured, resilient overlay 92. In the preferred embodiment, the overlay 92 is composed of a thermoplastic rubber compound that exhibits a high coefficient of friction, for example from 0.8 to 1.5, and a hardness in the range of 45–75 Shore A. Preferably, the overlay material is easy to process and is suited for use in hand grips. An example is the thermoplastic rubber compound sold by GLS Corporation under the trade designation DYNAFLEX® G-7707. Table A lists the typical physical properties for DYNAFLEX® G-7707.

TABLE A

| Property | Specification |
|---|---|
| Hardness, Shore A (ASTM D2240) injection molded | 45 |
| Specific gravity (D792) | 1.119 |
| Tensile modulus at 300% elongation (D412) in flow direction | 280 psi |
| Tensile strength at break (D412) in flow direction | 350 psi |
| Percent elongation at break | 500% |
| Tear strength (D624) in flow direction | 100 pli |

Figure 12:
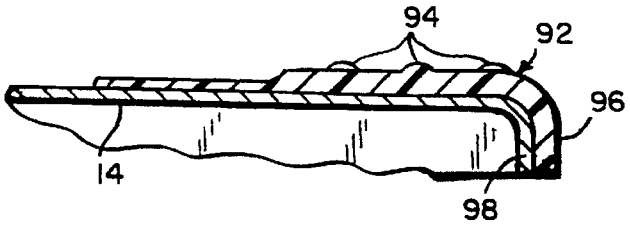
FIG. 12 is profile view of the press body in cross-section at line 12—12 of FIG. 11.
Figure 13:
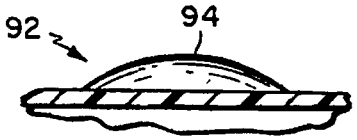
FIG. 13 is a detail of a circular bump of FIG. 12.

Preferably, the overlay 92 has substantially the same shape as the top plan view of the press body 14, except that it is shorter and narrower. As seen in FIG. 12, the curved side 96 of the overlay 92, extends downward such that it hugs the curved side 98 of the press body 14 when attached. The texturing of the overlay 92 includes raised circular bumps 94 arranged in three arcs that are parallel with the curved side 96. As seen in FIG. 13, the bumps 94 have a radius of curvature of about 0.125 inches and a height of between about 0.025 and 0.030 inches from the surface of the overlay 92.

Operation

There are two ways to operate the ergonomic paper punch 10. The first method involves placing the paper punch 10 in the flat surface of a table or desk. The paper to be punched 30 is inserted into the paper reception slot 24.

Figure 14:
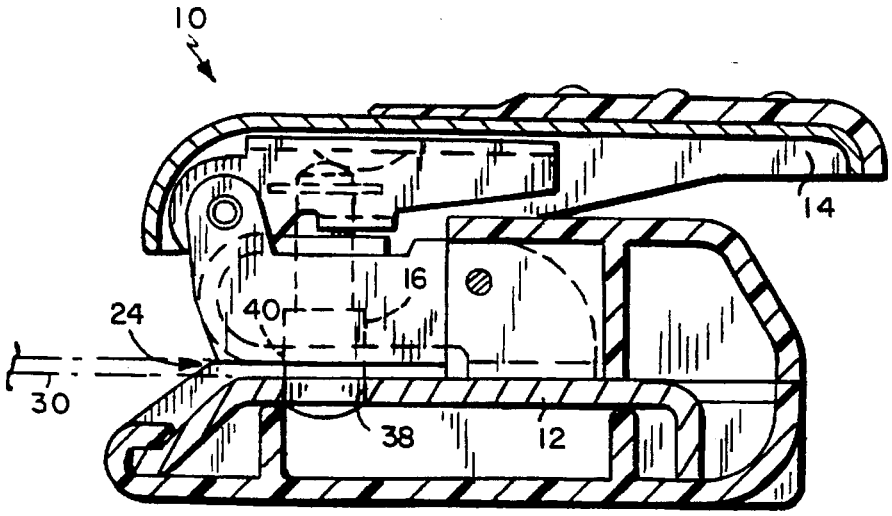
FIG. 14 is a profile of the paper punch in cross-section in its active position.

The operator presses the press body 14 down until the lower edge of the punch heads 54 have extended through the paper 30 and into the die holes 38, as shown in FIG. 14. Then the operator removes the pressure from the press body 14, which causes the punch heads 16 to retract from the die holes 38 and the paper 30. The operator then removes the paper 30 from the paper reception slot 24.

In the second method for operating the paper punch, the operator cradles the paper punch 10 in one of his or her hands, typically with the four fingers holding the non-slip surface of the tray 164 and the thumb holding the upper surface overlay 92. The paper to be punched 30 is inserted into the paper reception slot 24. The operator squeezes together the die body 12 and the press body 14 down until the lower edge of the punch heads 54 have extended through the paper 30 and into the die holes 38. Then the operator opens his or her hand, which causes the punch heads 16 to retract from the die holes 38 and the paper 30. The operator then removes the paper 30 from the paper reception slot 24.

What is claimed is:

1. An ergonomic paper punch comprising:

(a) a die body having a length and a width, a press body having a length and a width, a plurality of punch heads, and an axis of elongation;

(b) said die body and said press body being pivotally connected along a rocking axis for a rocking motion, said punch heads operating therebetween, and said rocking axis being substantially parallel to said axis of elongation;

(c) said punch having a cross-sectional profile substantially perpendicular to said axis of elongation, said profile having substantially a "V"-shape, said rocking axis being approximately at a vertex of said "V"-shape, and said vertex having an angle of approximately 30°;

(d) said die body providing a die base with die holes, a plurality of brackets with guide holes, and a paper reception region therebetween, said die base having a length, a width, and an upper surface, each of said die holes having an axis, and each of said guide holes having an axis;

(e) said punch heads being constrained by said guide holes for reciprocation along said die hole axes and said guide hole axes;

(f) said press body controlling axial retraction of said punch heads from said paper reception region, and axial projection of said punch heads through said paper reception region and into said die holes;

(g) said die body and said press body each having an inner rigid component and an outer resilient component, said outer resilient components having an outer surface;

(h) a portion of said outer surface of said press body outer resilient component having curved edges and a plurality of raised, smooth bumps;

(i) said die body having a punch-out holding region adjacent to said die holes and opposite said paper reception region;

(j) said die body outer resilient component being a tray, said tray covering said punch-out holding region and having a lower rear edge, a center portion of said lower rear edge being substantially monotonically curved over at least 10% of said die base width;

(k) said tray having an upper portion and a lower portion, said portions being connected by an integral hinge;

(l) said upper portion being attached to said die base upper surface by an attachment means, said hinge being located adjacent to said die base opposite said paper reception region, and said lower portion extending across said punch-out holding region;

(m) said lower portion being removable from said punch-out holding region and remaining attached to said die base by said upper portion via said hinge, whereby, when said tray is removed from said punch-out holding region, said punch-out holding region is emptied; and (n) said attachment means including ears extending substantially upwardly and perpendicularly from said die base upper surface, walls extending substantially downwardly and vertically from said upper portion of said tray, holes through each of said ears and said upper portion walls, all of said holes being aligned along a common axis, and a rod extending through said die body ear holes and said upper portion wall holes.

2. The ergonomic paper punch of claim 1, wherein said resilient components are composed of a thermoplastic rubber compound.

3. The ergonomic paper punch of claim 1, wherein said resilient components have a coefficient of friction in a range of about 0.8 to 1.5.

4. The ergonomic paper punch of claim 1, wherein said die base width is at least 20% of said die base length, said press body length is substantially equal to said die base length, said press body has three substantially straight sides adjacent to said rocking axis and a fourth side having a substantially smooth, convex curve, said press body width being greatest along a line that substantially bisects said press body length, and said press body width at said bisecting line being at least 22% of said press body length.

5. The ergonomic paper punch of claim 1, wherein said resilient tray has a closable aperture located at one end of said tray, whereby, when said aperture is open, said punch-out holding region is emptied, and when said aperture is closed, said punch-out holding region securely holds bits of paper produced by said axial projection when a sheet of paper is in said paper reception region.

6. The ergonomic paper punch of claim 1, wherein said plurality of punch heads includes a center punch head and two outer punch heads, said outer punch heads being spaced about 4.25 inches from said center punch head.

7. The ergonomic paper punch of claim 1, wherein said die body rigid component is composed of 0.074 inch cold rolled steel and said press body rigid component is composed of 0.035 inch cold rolled steel.

8. An ergonomic paper punch comprising:

(a) a die body having a length and a width, a press body having a length and a width, a plurality of punch heads, and an axis of elongation;

(b) said die body and said press body being pivotally connected along a rocking axis for a rocking motion, said punch heads operating therebetween, and said rocking axis being substantially parallel to said axis of elongation;

(c) said punch having a cross-sectional profile substantially perpendicular to said axis of elongation, said profile having substantially a "V"-shape, said rocking axis being approximately at a vertex of said "V"-shape, and said vertex having an angle of approximately 30°;

(d) said die body providing a die base with die holes, a plurality of brackets with guide holes, and a paper reception region therebetween, said die base having a length, a width, and an upper surface, each of said die holes having an axis, and each of said guide holes having an axis;

(e) said punch heads being constrained by said guide holes for reciprocation along said die hole axes and said guide hole axes;

(f) said press body controlling axial retraction of said punch heads from said paper reception region, and axial projection of said punch heads through said paper reception region and into said die holes;

(g) said die body and said press body each having an inner rigid component and an outer resilient component, said outer resilient components having an outer surface;

(h) said die base width being at least 20% of said die base length;

(i) said press body length being substantially equal to said die base length;

(j) said press body having three substantially straight sides adjacent to said rocking axis and a fourth side having a substantially smooth, convex curve, said press body width being greatest along a line that substantially bisects said press body length, and said press body width at said bisecting line being at least 22% of said press body length;

(k) said die body having a punch-out holding region adjacent to said die holes and opposite said paper reception region;

(l) said die body outer resilient component being a tray, said tray covering said punch-out holding region and having a lower rear edge, a center portion of said lower rear edge being substantially monotonically curved over at least 10% of said die base width;

(m) said tray having an upper portion and a lower portion, said portions being connected by an integral hinge;

(n) said upper portion being attached to said die base upper surface by an attachment means, said hinge being located adjacent to said die base opposite said paper reception region, and said lower portion extending across said punch-out holding region;

(o) said lower portion being removable from said punch-out holding region and remaining attached to said die base by said upper portion via said hinge, whereby, when said tray is removed from said punch-out holding region, said punch-out holding region is emptied;

(p) said attachment means including ears extending substantially upwardly and perpendicularly from said die base upper surface, walls extending substantially downwardly and vertically from said upper portion of said tray, holes through each of said ears and said upper portion walls, all of said holes being aligned along a common axis, and a rod extending through said die body ear holes and said upper portion wall holes;

(q) said resilient tray having a closable aperture, whereby, when said aperture is open, said punch-out holding region is emptied, and when said aperture is closed, said punch-out holding region securely holds bits of paper produced by said axial projection when a sheet of paper is in said paper reception region;

(r) a portion of said die body outer resilient component outer surface including a plurality of substantially parallel grooves substantially parallel to said axis of elongation; and (s) a portion of said press body outer resilient component outer surface including a plurality of raised, smooth bumps.

9. The ergonomic paper punch of claim 8, wherein said resilient components are composed of a thermoplastic rubber compound with a coefficient of friction in a range of about 0.8 to 1.5.

10. The ergonomic paper punch of claim 8, wherein said punch heads include a center punch head and two outer punch heads, said outer punch heads being spaced about 4.25 inches from said center punch head.

11. An ergonomic paper punch comprising:

(a) a die body having a length and a width, a press body having a length and a width, a plurality of punch heads, and an axis of elongation;

(b) said die body and said press body being pivotally connected along a rocking axis for a rocking motion, said punch heads operating therebetween, and said rocking axis being substantially parallel to said axis of elongation;

(c) said punch having a cross-sectional profile substantially perpendicular to said axis of elongation, said profile having substantially a "V"-shape, said rocking axis being approximately at a vertex of said "V"-shape, and said vertex having an angle of approximately 30°;

(d) said die body providing a die base with die holes, a plurality of brackets with guide holes, and a paper reception region therebetween, said die base having a length, a width, and an upper surface, each of said die holes having an axis, and each of said guide holes having an axis;

(e) said punch heads being constrained by said guide holes for reciprocation along said die hole axes and said guide hole axes;

(f) said press body controlling axial retraction of said punch heads from said paper reception region, and axial projection of said punch heads through said paper reception region and into said die holes;

(g) said die body and said press body each having an inner rigid component and an outer resilient component, said outer resilient components having an outer surface;

(h) said die base width being at least 20% of said die base length;

(i) said press body length being substantially equal to said die base length;

(j) said press body having three substantially straight sides adjacent to said rocking axis and a fourth side having a substantially smooth, convex curve, said press body width being greatest along a line that substantially bisects said press body length, and said press body width at said bisecting line being at least 22% of said press body length;

(k) said die body having a punch-out holding region adjacent to said die holes and opposite said paper reception region;

(l) said die body outer resilient component being a tray, said tray covering said punch-out holding region and having a lower rear edge, a center portion of said lower rear edge being substantially monotonically curved over at least 10% of said die base width;

(m) said tray having an upper portion and a lower portion, said portions being connected by an integral hinge;

(n) said upper portion being attached to said die base upper surface by an attachment means, said hinge being located adjacent to said die base opposite said paper reception region, and said lower portion extending across said punch-out holding region;

(o) said lower portion being removable from said punch-out holding region and remaining attached to said die base by said upper portion via said hinge, whereby, when said tray is removed from said punch-out holding region, said punch-out holding region is emptied;

(p) said attachment means including ears extending substantially upwardly and perpendicularly from said die base upper surface, walls extending substantially downwardly and vertically from said upper portion of said tray, holes through each of said ears and said upper portion walls, all of said holes being aligned along a common axis, and a rod extending through said die body ear holes and said upper portion wall holes;

(q) said resilient tray having a closable aperture, whereby, when said aperture is open, said punch-out holding region is emptied, and when said aperture is closed, said punch-out holding region securely holds bits of paper produced by said axial projection when a sheet of paper is in said paper reception region; and (r) a portion of said press body outer resilient component outer surface including a plurality of raised, smooth bumps.

* * * * *